US006766905B1

(12) United States Patent
Chang

(10) Patent No.: US 6,766,905 B1
(45) Date of Patent: Jul. 27, 2004

(54) GOLF BAG

(76) Inventor: Ruey-Yang Chang, P.O. Cox 453, Taichung Hsien (TW)

( * ) Notice: Subject to any disclaimer, the term of this patent is extended or adjusted under 35 U.S.C. 154(b) by 95 days.

(21) Appl. No.: 10/216,331

(22) Filed: Aug. 12, 2002

(51) Int. Cl.[7] ..... A63B 55/04
(52) U.S. Cl. ..... 206/315.7; 248/96; 206/315.6
(58) Field of Search ..... 206/315.3, 315.7, 206/315.6; 211/70.2; 248/96

(56) References Cited

U.S. PATENT DOCUMENTS 1,678,922 A * 7/1928 Singer ..... 248/96
1,769,011 A * 7/1930 Bickford ..... 248/96
1,882,785 A * 10/1932 Doughty ..... 248/96
4,082,218 A * 4/1978 Paulinski ..... 714/47
5,474,175 A * 12/1995 Gattis ..... 206/315.3
5,718,401 A * 2/1998 Walters ..... 248/150
6,010,101 A * 1/2000 Stein et al. ..... 248/96
6,220,433 B1 * 4/2001 Kang ..... 206/315.7
6,227,503 B1 * 5/2001 Shiao Chen ..... 248/96
6,435,345 B1 * 8/2002 Wang ..... 206/315.7

* cited by examiner

*Primary Examiner*—Tri M. Mai
(74) *Attorney, Agent, or Firm*—Harrison & Egbert

(57) ABSTRACT

A golf bag includes a bag body, a top seat, a bottom seat, an arresting seat, a pivoting mount, two pivoting arms, two support rods, a link unit, a retaining piece, and a locating block. The bag body is tilted by the two support rods in conjunction with the arresting seat. The support rods are fastened to the pivoting arms which are pivoted with the pivoting mount in such a manner that the support rods are securely located at such time when the support rods are at work to support the bag body in the slanting position. The locating block is provided with two locating recesses for locating securely the bottom ends of the support rods at such time when the bag body is kept in the upright position, thereby preventing the support rods from swaying.

7 Claims, 7 Drawing Sheets

GOLF BAG

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to golfing equipment, and more particularly to a golf bag.

BACKGROUND OF THE INVENTION

The conventional golf bags have several structural shortcomings. The top seat of the conventional golf bag is generally made of a rigid plastic material, which is covered with the artificial sponge or cloth. As a result, the top seat is not cost-effective. In addition, the golf bag tilting mechanism of the conventional golf bags comprises two support rods, two steel link cords, and an arresting seat. When the golf bag is tilted on a surface, the golf bag is supported on the surface by the two support rods in conjunction with the arresting seat. In light of the support rods being braced by the steel link cords, the tilted golf bag cannot be held firmly on the surface. Moreover, the support rods are prone to sway when the golf bag is kept in the upright position.

BRIEF SUMMARY OF THE INVENTION

The primary objective of the present invention is to provide a golf bag which is free of the structural shortcomings of the conventional golf bags described above.

In keeping with the principle of the present invention, the foregoing objective of the present invention is attained by the golf bag comprising a bottom seat, a top seat, an arresting seat, a link unit, and two support rods. The golf bag is tilted by the two support rods and the arresting seat. The support rods are provided with a pivoting arm which is in turn provided with a locating portion to locate the support rod at the time when the support rods are at work to support the tilted bag. The support rods are confined by a locating block at the time when the golf bag is kept in an upright position. The link unit is provided with a retaining piece serving to hold and adjust the degree of force of the link unit. The top seat is made of a plastic material having an appropriate softness.

The features and the advantages of the present invention will be more readily understood upon a thoughtful deliberation of the following detailed description of the present invention with reference to the accompanying drawings.

DETAILED DESCRIPTION OF THE INVENTION

Figure 1:
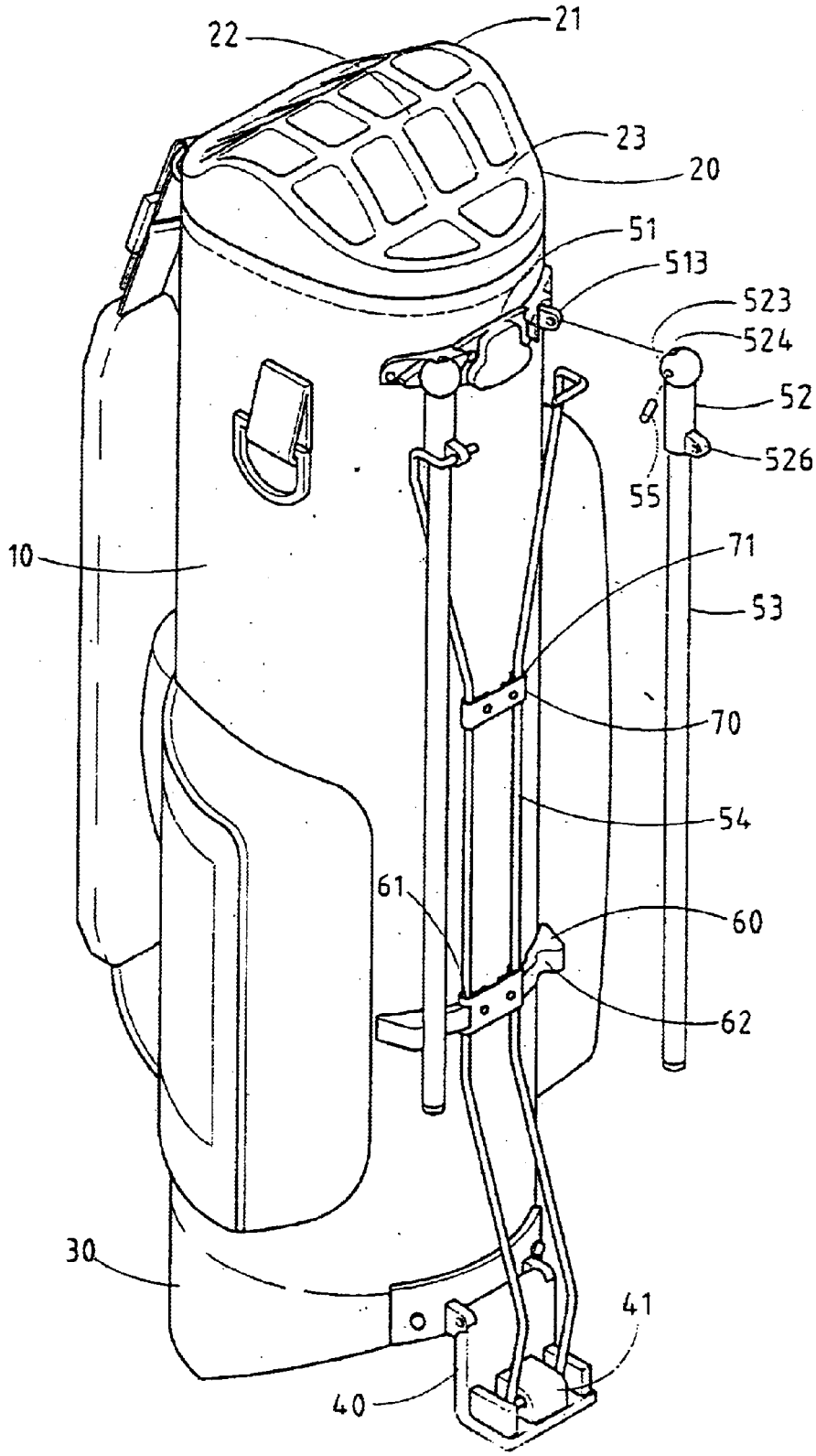
FIG. 1 shows a schematic view of the present invention.
Figure 2:
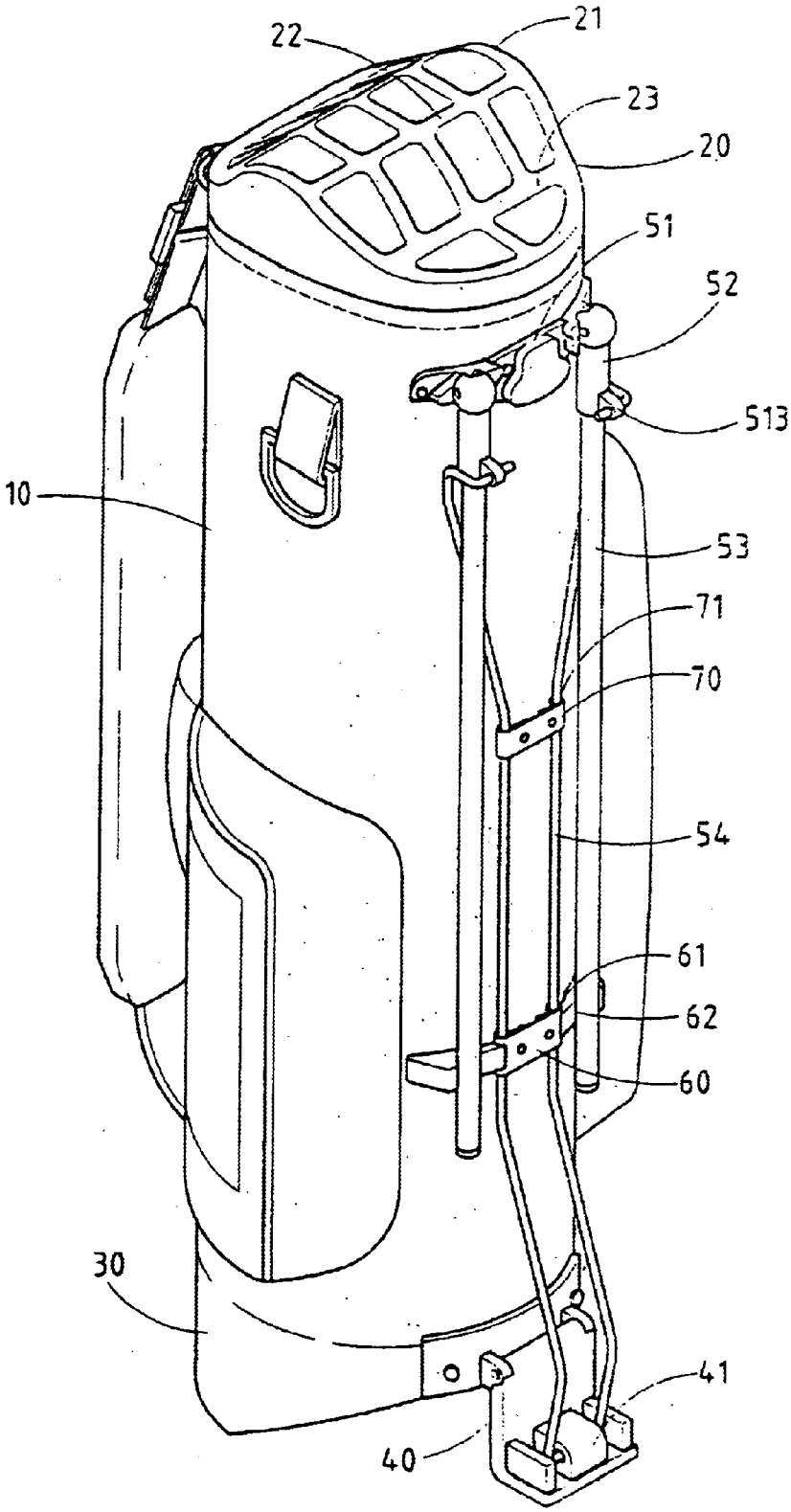
FIG. 2 shows a perspective view of the present invention.

As shown in FIGS. 1 and 2, a golf bag of the present invention comprises a bag body 10, a top seat 20, a bottom seat 30, an arresting seat 40, a pivoting mount 51, two pivoting arms 52, two support rods 53, a link unit 54, a locating block 60, and a retaining piece 70.

Figure 3:
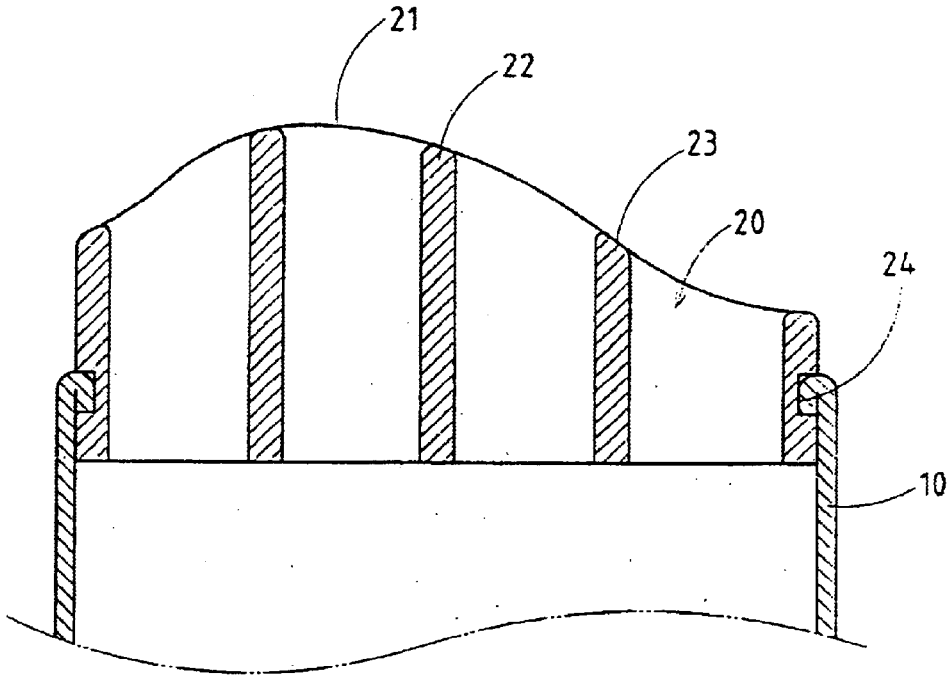
FIG. 3 shows a longitudinal sectional view of the top seat of the present invention.
Figure 4:
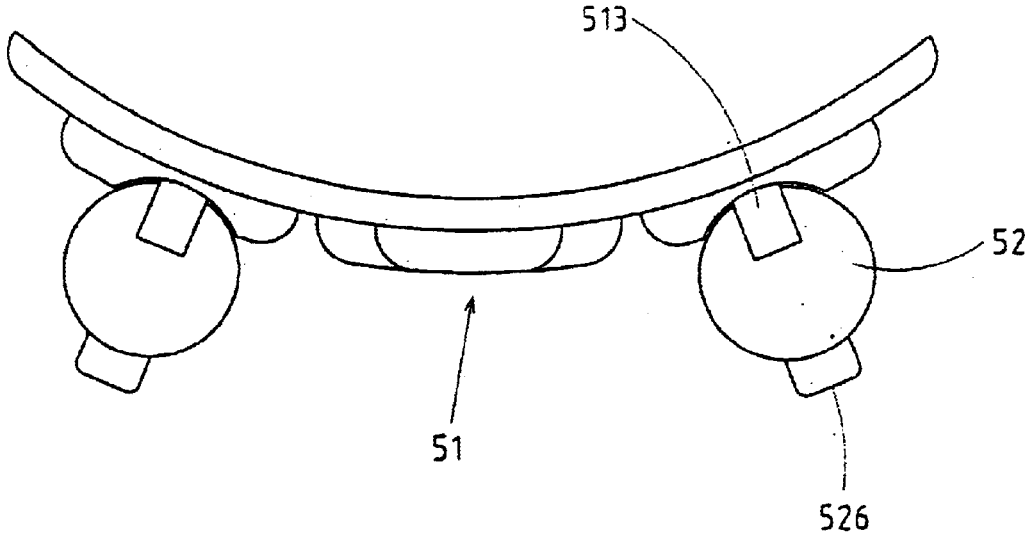
FIG. 4 shows a top plan view of a pivoting portion of the top seat and the pivoting arm of the present invention.

The top seat 20 is fastened with the top end of the bag body 10 and is made of a plastic material having an appropriate softness. The top seat 20 is provided in the outer side with a ridge 21. The top seat 20 comprises a plurality of longitudinally-oriented ribs 22 and 23 of various heights. These ribs serve to form and define a plurality of locating holes for locating shafts of the golf clubs. The top seat 20 is provided in the periphery with a groove 24 which is used to join the top seat 20 with the top end of the bag body 10, as shown in FIG. 3.

The bottom seat 30 is fastened with the bottom end of the bag body 10.

The arresting seat 40 is pivoted with the bottom seat 30 and is provided with a fastening block 41.

The pivoting mount 51 is fastened to the outer side of the top end of the bag body 10 and is provided with two pivoting lugs 513.

Figure 6:
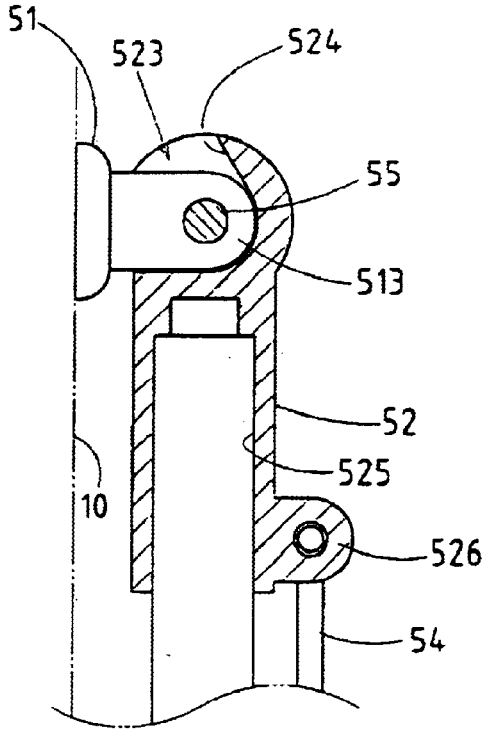
FIG. 6 shows a longitudinal sectional view of the pivoting arm of the present invention in the upright position.
Figure 7:
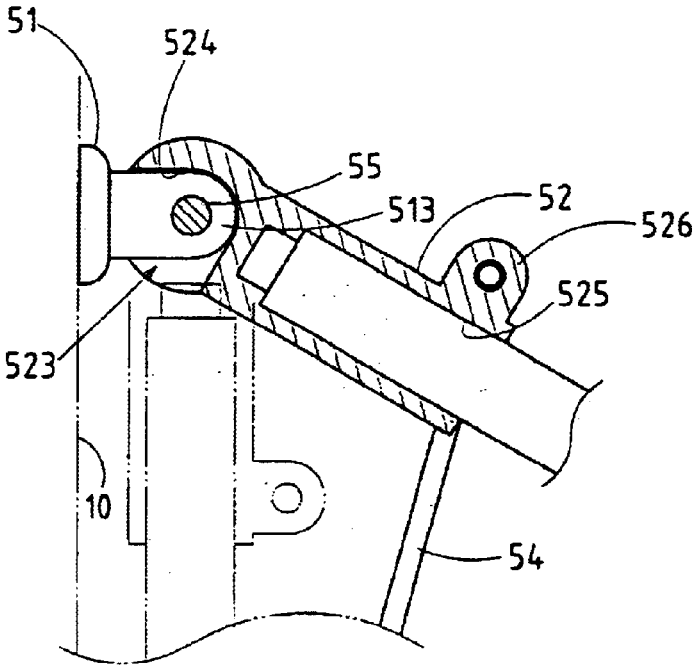
FIG. 7 shows a longitudinal sectional view of the pivoting arm of the present invention in the slanting position.

The two pivoting arms 52 are provided at the top end with a pivoting slot 523 and are pivotally fastened with the pivoting mount 51 such that the pivoting lug 513 and the pivoting slot 523 are fastened together by a pivot 55, as shown in FIG. 6. The pivoting slot 523 of the pivoting arms 52 is provided with a confining edge 524 capable of confining the pivoting arm 52 in conjunction with the top edge of the pivoting lug 513 of the pivoting mount 51, as illustrated in FIG. 7. The pivoting arms 52 are provided at the bottom end with a retaining hole 525 and a projection 526 having a hole.

The two support rods 53 are fastened with the two pivoting arms 52 such that the top end of the support rods 53 is retained in the retaining hole 525 of the pivoting arms 52.

The link unit 54 is made of a steel cord and is of an elongated U-shaped construction. The bottom end of the link unit 54 is connected to the fastening block 41 of the arresting seat 40 while the top end of the link unit 54 is fastened with the projections 526 of the pivoting arms 52.

Figure 8:
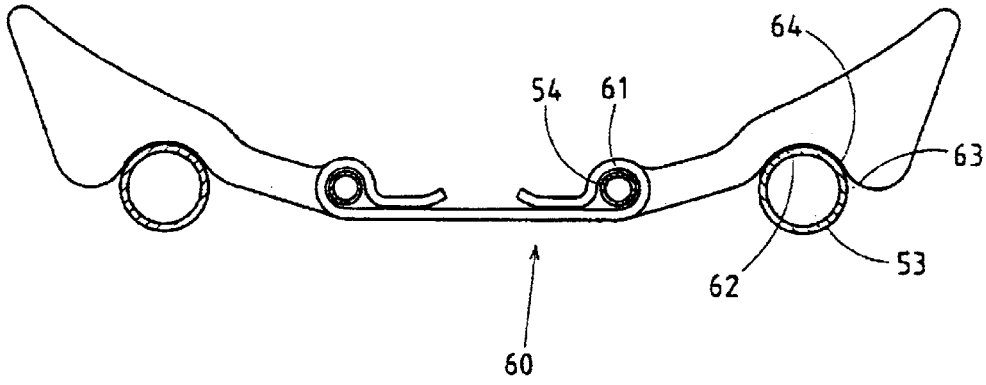
FIG. 8 shows a top plan view of the locating block of the present invention at work to locate the support rods in the upright position.

The locating block 60 is fastened to the outer side of the bag body 10 such that the locating block 60 is corresponding in location to the bottom end segment of the support rods 53. The locating block 60 is provided with a through hole 61 through which the link unit 54 is put. The locating block 60 is provided with two locating recesses 62 for locating the support rods 53, as shown in FIG. 8. The locating recesses 62 have an arcuate portion 64 which is provided in two opposite ends with a confining edge 63. When the two support rods 53 are retracted to keep the bag body 10 in the upright position, the support rods 53 are located in the locating recesses 62 of the locating block 60, thereby preventing the support rods 53 from swaying.

The retaining piece 70 has two ends which are so looped as to form two through holes 71. The retaining piece 70 is fastened to the outer side of the bag body 10 such that the retaining piece 70 is located between the pivoting mount 51 and the locating block 60. The link unit 54 is put through the through holes 71 of the retaining piece 70. The retaining piece 70 is used to keep and adjust the degree of force of the link unit 54.

Figure 5:
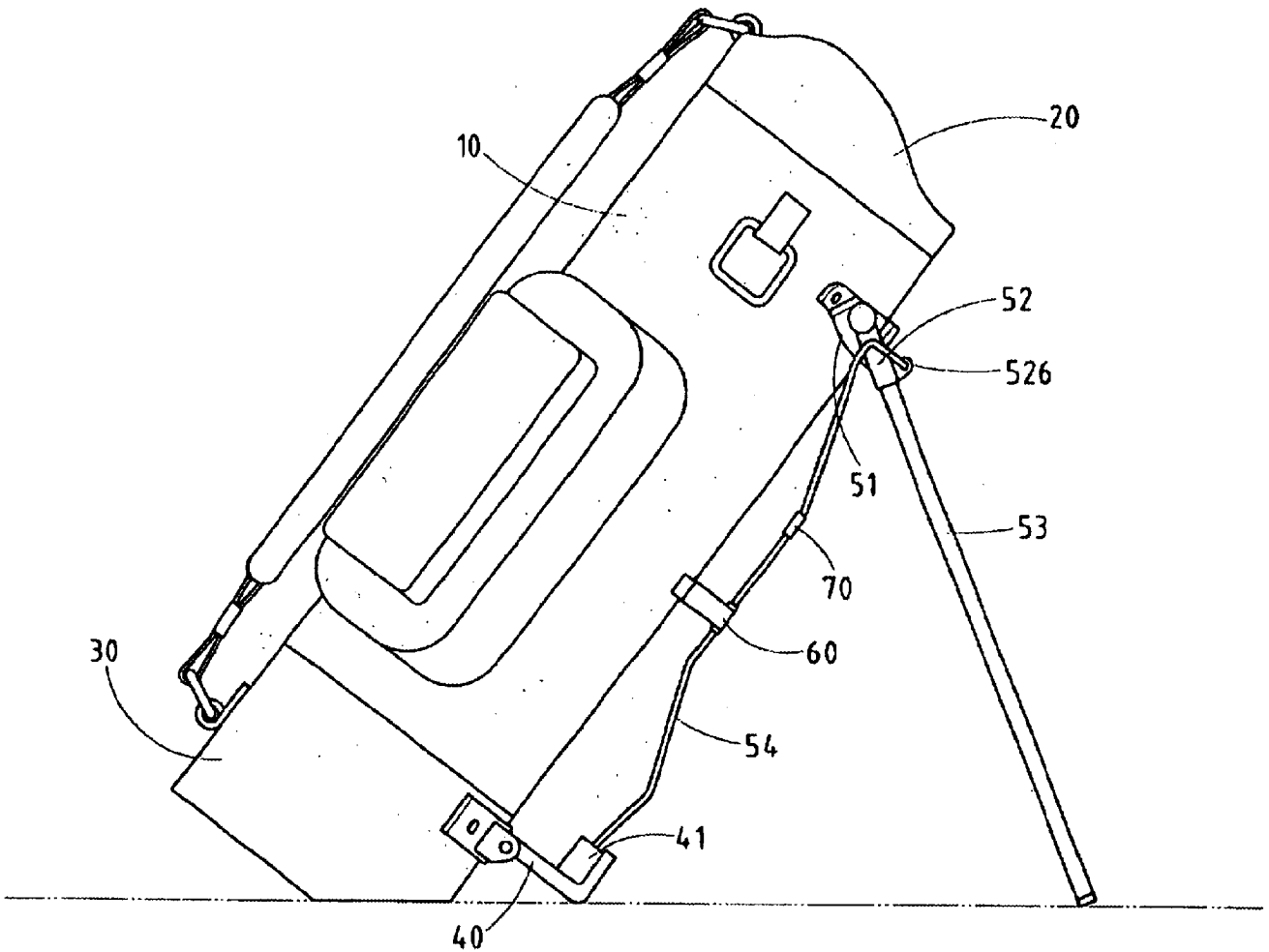
FIG. 5 shows a side schematic view of the present invention in the slanting position.

As shown in FIG. 5, when the bag body 10 is tilted, the distance between the arresting seat 40 and the pivoting arms 52 is shortened, thereby causing the top ends of the link unit 54 to push the pivoting arms 52 to turn in relation to the pivoting lugs 513 of the pivoting mount 51. As a result, the two support rods 53 are caused to move away from the locating block 60 such that the free ends of the support rods 53 are rested on a surface so as to support the bag body 10 in the slanting position in conjunction with the arresting seat 40. The bag body 10 is securely tilted due to the two pivoting arms 52 whose confining edges 524 are rested against the pivoting lugs 513 of the pivoting mount 51. In another words, the two support rods 53 are securely located on the surface so as to ensure that the bag body 10 is securely tilted. The tilting process described above is reversible so as to enable the bag body 10 to return to its original upright position.

The present invention described above is to be construed in all respects as being illustrative and nonrestrictive. Accordingly, the present invention may be embodied in other specific forms without deviating from the spirit thereof The present invention is therefore to be limited only by the scopes of the following claims.

I claim:

1. A golf bag comprising:

a bag body;

a top seat fastened to a top end of said bag body and comprised of a plurality of ribs whereby said ribs form and define a plurality of through holes in said top seat to locate shafts of golf clubs;

a bottom seat fastened to a bottom end of said bag body;

an arresting seat pivoted with said bottom seat and comprised of a fastening block;

a pivoting mount fastened to an outer side of the top end of said bag body and comprised of two pivoting lugs;

two pivoting arms provided at a top end with a pivoting slot, and at a bottom end with a retaining hole whereby said pivoting arms are pivoted with said pivoting mount such that said pivoting slots of said pivoting arms and said pivoting lugs of said pivoting mount are pivoted together by a pivot, said pivoting arms further provided at a bottom end with a projection;

two support rods fastened at a top end to a bottom end of said pivoting arms such that the top end of said support rods is retained in said retaining hole of the bottom end of said pivoting arms;

a locating block comprised of two locating recesses and a through hole disposed between said two locating recesses whereby said locating block is fastened to the outer side of said bag body such that said locating block is corresponding in location to a bottom end of said support rods, and that said two locating recesses serve to locate the bottom ends of said two support rods; and a link unit fastened at a top end to said projection of said two pivoting arms, and at a bottom end to said fastening block of said arresting seat via said through hole of said locating block.

2. The golf bag as defined in claim 1, wherein said pivoting slot of said pivoting arms is comprised of a confining edge for confining the top end of said pivoting arms in conjunction with said pivoting lug of said pivoting mount.

3. The golf bag as defined in claim 1, wherein said locating recesses of said locating block are comprised of two confining edges and an arcuate portion located between said two confining edges.

4. The golf bag as defined in claim 1, further comprising a retaining piece whereby said retaining piece is comprised of at least one through hole and is fastened to the outer side of said bag body such that said retaining piece is disposed between said pivoting mount and said locating block, and that said link unit is pivoted in said through hole of said retaining piece.

5. The golf bag as defined in claim 1, wherein said top seat is comprised of a plastic material having a softness.

6. The golf as defined in claim 5, wherein said top seat is provided in a top surface with a ridge, and in an interior with a plurality of ribs of various heights.

7. The golf bag as defined in claim 5, wherein said top seat is provided in a periphery with a groove whereby said groove is used to join said top seat with the top end of said bag body.

* * * * *